US008165501B2

(12) United States Patent
Tamura et al.

(10) Patent No.: US 8,165,501 B2
(45) Date of Patent: Apr. 24, 2012

(54) IMAGE FORMING APPARATUS HAVING CLEANING UNIT FIXED TO DRAWER

(75) Inventors: Aya Tamura, Tajimi (JP); Shougo Sato, Seto (JP); Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/686,406

(22) Filed: Jan. 13, 2010

(65) Prior Publication Data

US 2010/0178078 A1 Jul. 15, 2010

(30) Foreign Application Priority Data

Jan. 13, 2009 (JP) ..... 2009-004719

(51) Int. Cl.
*G03G 21/16* (2006.01)

(52) U.S. Cl. ..... 399/123; 399/101

(58) Field of Classification Search ..... 399/101, 399/110, 111, 113, 119, 123, 124, 126
See application file for complete search history.

(56) References Cited

U.S. PATENT DOCUMENTS 5,581,342 A 12/1996 Yamauchi
6,041,206 A * 3/2000 Park
6,445,899 B2 9/2002 Sato
6,735,406 B1 * 5/2004 Noda ..... 399/111
7,447,467 B2 11/2008 Kamimura et al.
2001/0002953 A1 6/2001 Sato
2006/0067734 A1 3/2006 Igarashi et al.
2006/0127146 A1 * 6/2006 Morita et al.
2006/0140673 A1 6/2006 Kamimura et al.
2006/0140674 A1 * 6/2006 Sato ..... 399/119
2006/0216056 A1 * 9/2006 Okabe ..... 399/101

FOREIGN PATENT DOCUMENTS

JP 08-054811 2/1996
JP 2001-166556 A 6/2001
JP 2001-296711 A 10/2001
JP 2001-305829 A 11/2001
JP 2003-216006 A 7/2003
JP 2003216006 A * 7/2003

(Continued)

OTHER PUBLICATIONS

Japanese Office Action dated Dec. 28, 2010 in Application No. JP2009-004719 and English Translation thereof.

(Continued)

*Primary Examiner* — David Porta
*Assistant Examiner* — Milton Gonzalez
(74) *Attorney, Agent, or Firm* — Banner & Witcoff, Ltd.

(57) ABSTRACT

There is provided an image forming apparatus including a main body, a drawer, an image forming unit, a belt unit and a cleaning unit. The drawer is movably supported to the main body and configured to be pulled out from an interior of the main body. The image forming unit is supported on the drawer and has photosensitive drums arrayed in line in a direction for forming an image on a recording medium. The belt unit is disposed in opposition to each of the photosensitive drums and extends in the direction. The cleaning unit is fixed to the drawer and is disposed at a side the same as the image forming unit with respect to the belt unit, such that the cleaning unit is pulled out integrally with the image forming unit from the main body.

8 Claims, 6 Drawing Sheets

FOREIGN PATENT DOCUMENTS

| | | | |
|---|---|---|---|
| JP | 2004-061798 | A | 2/2004 |
| JP | 2004-191758 | A | 7/2004 |
| JP | 2005-025233 | A | 1/2005 |
| JP | 2005-156619 | A | 6/2005 |
| JP | 2006-098772 | | 4/2006 |
| JP | 2006-184552 | A | 7/2006 |
| JP | 2007-218936 | | 8/2007 |

OTHER PUBLICATIONS

JP Office Action Mar. 22, 2003, JP Appln. 2009-004719, English translation.

JP Examiner's Opinion dated Sep. 20, 2011, corresponding Application No. 2009-004719; English Translation.

* cited by examiner

IMAGE FORMING APPARATUS HAVING CLEANING UNIT FIXED TO DRAWER

CROSS REFERENCE TO RELATED APPLICATION

This application claims priority from Japanese Patent Application No. 2009-004719 filed Jan. 13, 2009. The entire content of the priority application is incorporated herein by reference.

TECHNICAL FIELD

The present invention relates to an image forming apparatus such as a color laser printer.

BACKGROUND

Conventionally, an image forming apparatus includes a plurality of developing devices each accommodating toner of a different color, a plurality of photosensitive drums to which each toner is supplied, a conveyor belt for conveying each sheet, and a plurality of transferring devices for transferring each toner to each sheet. The plurality of photosensitive drums is juxtaposed and each sheet is printed in color when passing between each photosensitive drum and the belt unit.

In such a conventional image forming apparatus, for an easy maintenance, each photosensitive drum is supported in a photosensitive drum unit as an integral unit, and the photosensitive drum unit itself is configured to be detachably mountable in the image forming device. Also, a cleaning unit has been provided for cleaning toner and paper dusts deposited on the conveyor belt. Conventionally, the photosensitive drum unit is disposed upward of the conveyor belt, while the cleaning unit is disposed below the conveyor belt.

SUMMARY

The cleaning unit needs maintenance. In the conventional image forming apparatus, the conveyor belt has to be removed first for performing maintenance to the cleaning unit since the cleaning unit is disposed below the conveyor belt. Further, such a conventional arrangement of photosensitive drum, a conveyor belt and the cleaning unit inevitably requires a large dimension in height, resulting in a large image forming apparatus.

In view of the foregoing, it is an object of the present invention to provide a compact image forming apparatus capable of facilitating maintenance to a cleaning unit.

In order to attain the above and other objects, there is provided an image forming apparatus including a main body, a drawer, an image forming unit, a belt unit and a cleaning unit. The drawer is movably supported to the main body and configured to be pulled out from an interior of the main body. The image forming unit is supported on the drawer and has a plurality of photosensitive drums arrayed in line in a first direction for forming an image on a recording medium. The belt unit is disposed in opposition to each of the plurality of photosensitive drums and extends in the first direction. The cleaning unit is fixed to the drawer and is disposed at a side the same as the image forming unit with respect to the belt unit, whereby the cleaning unit is pulled out integrally with the image forming unit from the main body.

DETAILED DESCRIPTION

First, a general configuration of a color laser printer 1 according to an embodiment of the present invention will be described with reference to FIG. 1. In the following description, directions will be referred to assuming that the color printer 1 is disposed in an orientation in which it is intended to be used. Specifically, in FIG. 1, the right side of the color printer 1 will be referred to as the "front (near) side," the left side of the color printer 1 will be referred to as the "rear (far) side," the far side with respect to the paper width will be referred to as the "right side," and the near side with respect to the paper width will be referred to as the "left side." Further, the up-to-down direction in FIG. 1 will be referred to as the "vertical direction."

Figure 1:
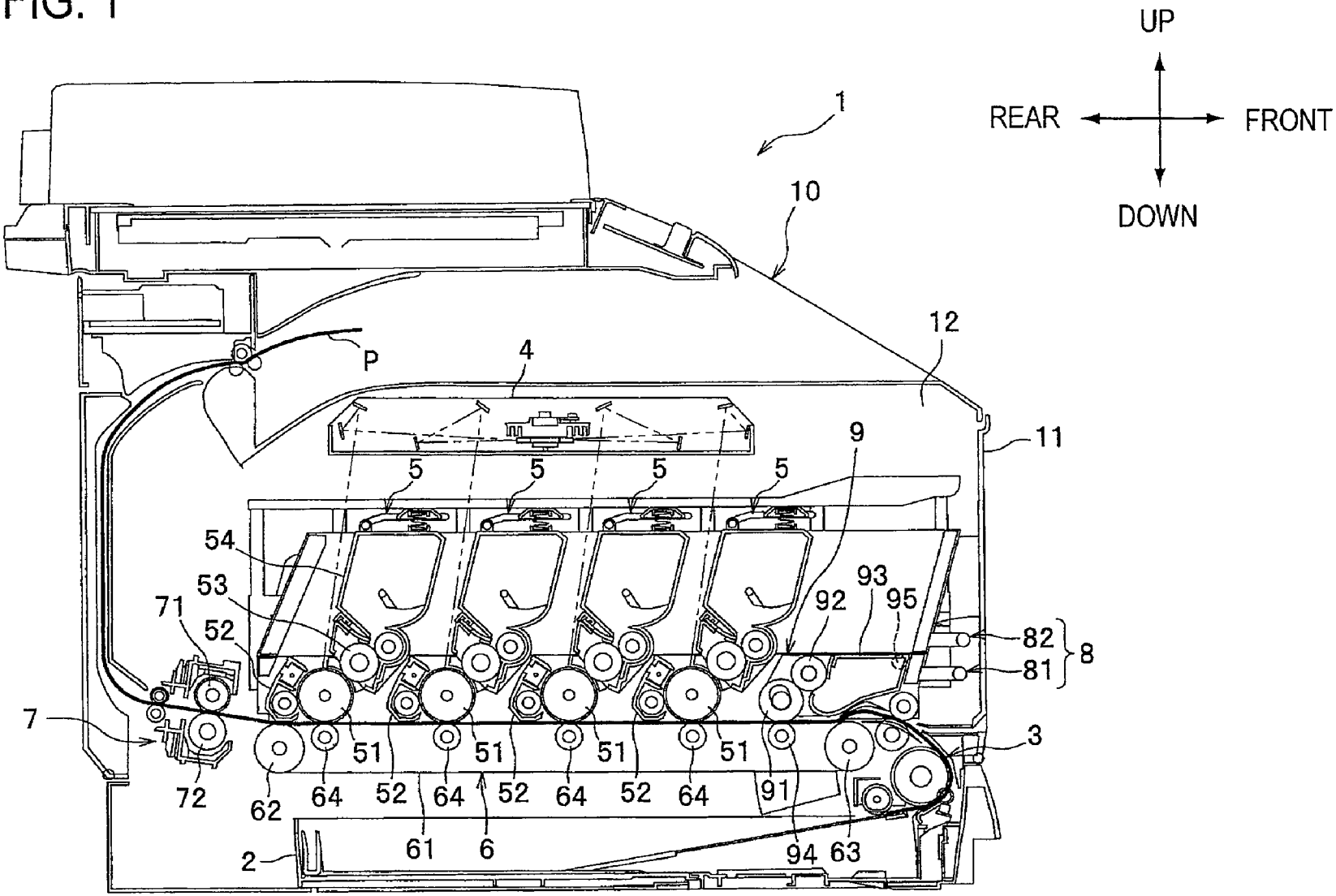
FIG. 1 is a cross-sectional view showing a general configuration of a color printer according to an embodiment of the present invention, the color printer including a conveyor belt, a cleaning unit and a developing device drawer.

As shown in FIG. 1, the color printer 1 has a main body 10 within which a sheet tray 2, a sheet feeding unit 3, a scanning unit 4, a plurality of process cartridges 5, a belt unit 6 and a fixing unit 7 are provided.

The main body 10 includes a pair of side frames 12 at the left and right sides and is provided with a front cover 11 at the front side. The front cover 11 is pivotably movably supported to the main body 10 about a pivot shaft 11A (See FIGS. 2 and 3).

The sheet tray 2 accommodates sheets P as an example of recording mediums. The sheet tray 2 is detachably mounted in the main body 10 in the front-to-rear direction through an opening that is formed when the front cover 11 is opened.

The sheet feeding unit 3 is adapted to feed the sheets P accommodated in the sheet tray 2 to the belt unit 6. The sheet feeding unit 3 includes a well-known sheet feed roller and a pair of registration rollers (not designated with reference numerals).

The scanning unit 4 has a conventional configuration that includes a laser emitting section (not shown), polygon mirrors, lenses and reflection mirrors (illustrated in FIG. 1 but not designated with reference numerals). In the scanning unit 4, the laser emitting section irradiates a laser beam onto surfaces of photosensitive drums 51 (to be described later) in the process cartridges 5 at a high speed.

Each process cartridge 5 includes a photosensitive drum 51, a drum unit 52 and a developing device 54. The drum unit 52 includes a charger (shown without a reference numeral). The developing device 54 includes a developing roller 53, a toner accommodation chamber and a supply roller (shown without reference numerals). The developing device 54 is detachably mountable on the drum unit 52.

The process cartridges 5 are integrally supported to a drawer 8 such that the photosensitive drums 51 are juxtaposed in the front-to-rear direction. The drawer 8 is disposed within the main body 10 so as to be pulled out from the opening when the front cover 11 is opened.

The drawer 8 includes a cleaning unit 9 for cleaning a conveyor belt 61 (to be described later) of the belt unit 6. The cleaning unit 9 is fixed to the drawer 8. Detailed configurations of the drawer 8 and the cleaning unit 9 will be described later.

In the process cartridges 5, each photosensitive drum 51 is charged by the corresponding charger. The surface of each photosensitive drum 51 is then exposed to the laser beam emitted from the scanning unit 4, thereby forming a latent electrostatic image thereon. The toner accommodated in respective toner accommodation chamber is then supplied to the latent electrostatic image formed on the surface of the corresponding photosensitive drum 51 via the supply roller and the developing roller 53. In this way, a visible toner image is carried on the surface of each photosensitive drum 51.

The belt unit 6 includes a frame 65 (See FIGS. 4A and 4B) for supporting an endless conveyor belt 61, a drive roller 62, a follower roller 63 and a plurality of transfer rollers 64. The conveyor belt 61 is disposed in opposition to each of the photosensitive drum 51. Each photosensitive drum 51 has a bottom end portion in contact with the conveyor belt 61. The drive roller 62 and the follower roller 63 are disposed in opposition to each other with a prescribed distance kept therebetween so that the conveyor belt 61 can be stretched around the drive roller 62 and the follower roller 63 under tension. Each transfer roller 64 is disposed within the loop of the conveyor belt 61 at a position corresponding to each of the photosensitive drum 51. The conveyor belt 61 moves in accordance with the rotation of the drive roller 62. While being conveyed along the conveyor belt 61, the sheet P passes between the conveyor belt 61 and each photosensitive drum 51. At this time, the toner carried on the surfaces of the photosensitive drums 51 is attracted toward the transfer rollers 64, thereby transferring the toner image onto the sheet P.

The fixing unit 7 is adapted to thermally fix the toner image transferred on the sheet P. The fixing unit 7 includes a well-known heat roller 71 and a pressure roller 72. The sheet P is then discharged out of the main body 10 with a plurality of conveyor rollers (not shown).

Next, a configuration of the drawer 8 will be described with reference to FIGS. 2 and 3.

The drawer 8 includes a first drawer 81 and a second drawer 82, as shown in FIG. 1. The first drawer 81 detachably supports each of the drum units 52 therein. The second drawer 82 detachably supports each of the developing devices 54 therein.

The cleaning unit 9 is securely fixed to the first drawer 81 by screwing or welding. As shown in FIG. 2, the first drawer 81 is disposed below the second drawer 82. The first drawer 81 is supported to the pair of side frames 12 constituting side walls of the main body 10 so that the first drawer 81 can move in the front-to-rear direction.

Figure 2:
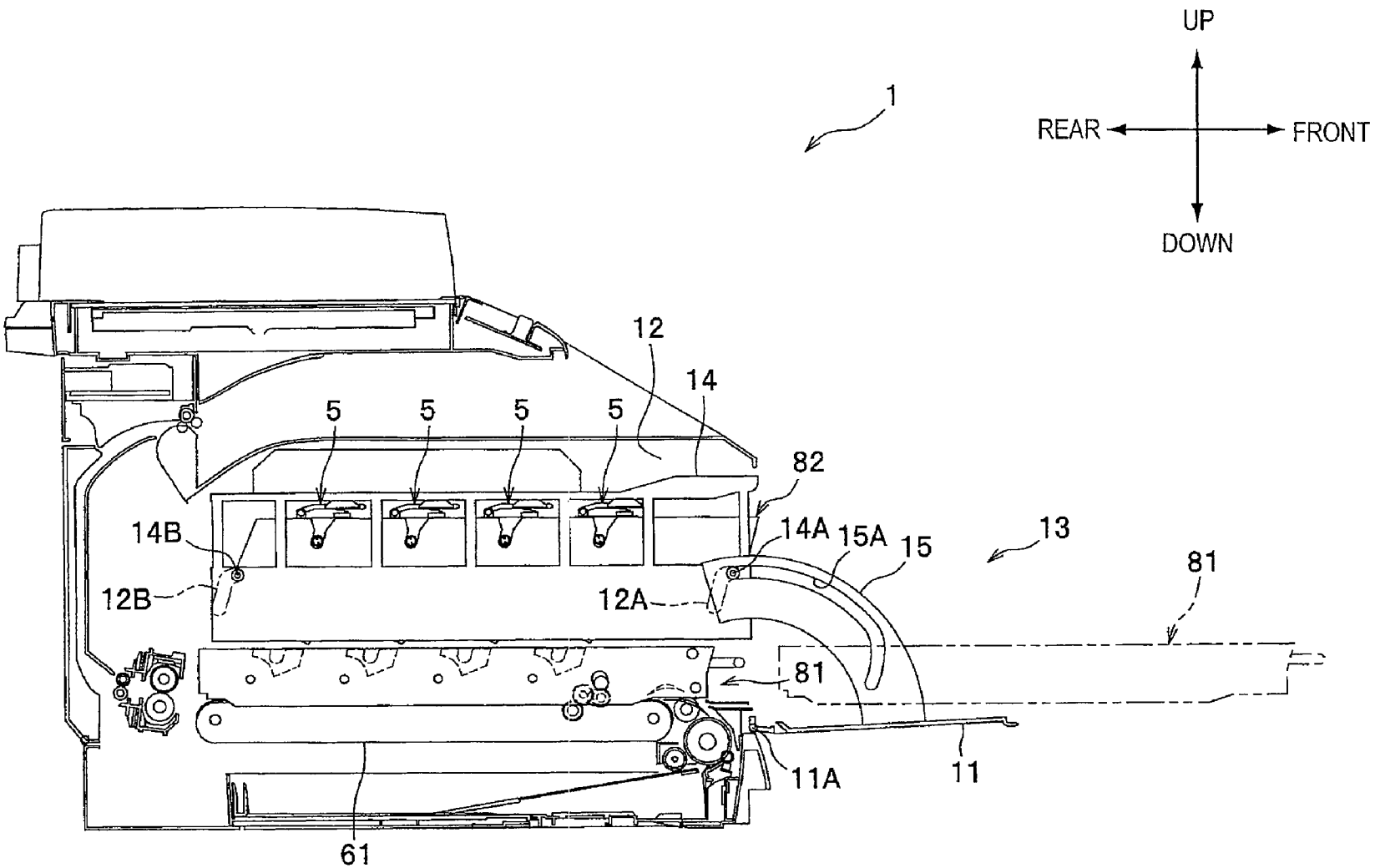
FIG. 2 is a cross-sectional view of the color printer according to the present invention when a front cover thereof is opened.

As shown in FIG. 2, the second drawer 82 is allowed to be movable away from the first drawer 81 by a separation mechanism 13 (to be described next) in conjunction with the movement of the front cover 11.

The separation mechanism 13 includes a pair of supporting frames 14 and a pair of lifter plates 15. Each supporting frame 14 is disposed at a position adjacent to each side of the second drawer 82 with respect to the left-to-right direction. The lifter plate 15 is adapted to urge front portions of the supporting frames 14 upward.

Figure 3:
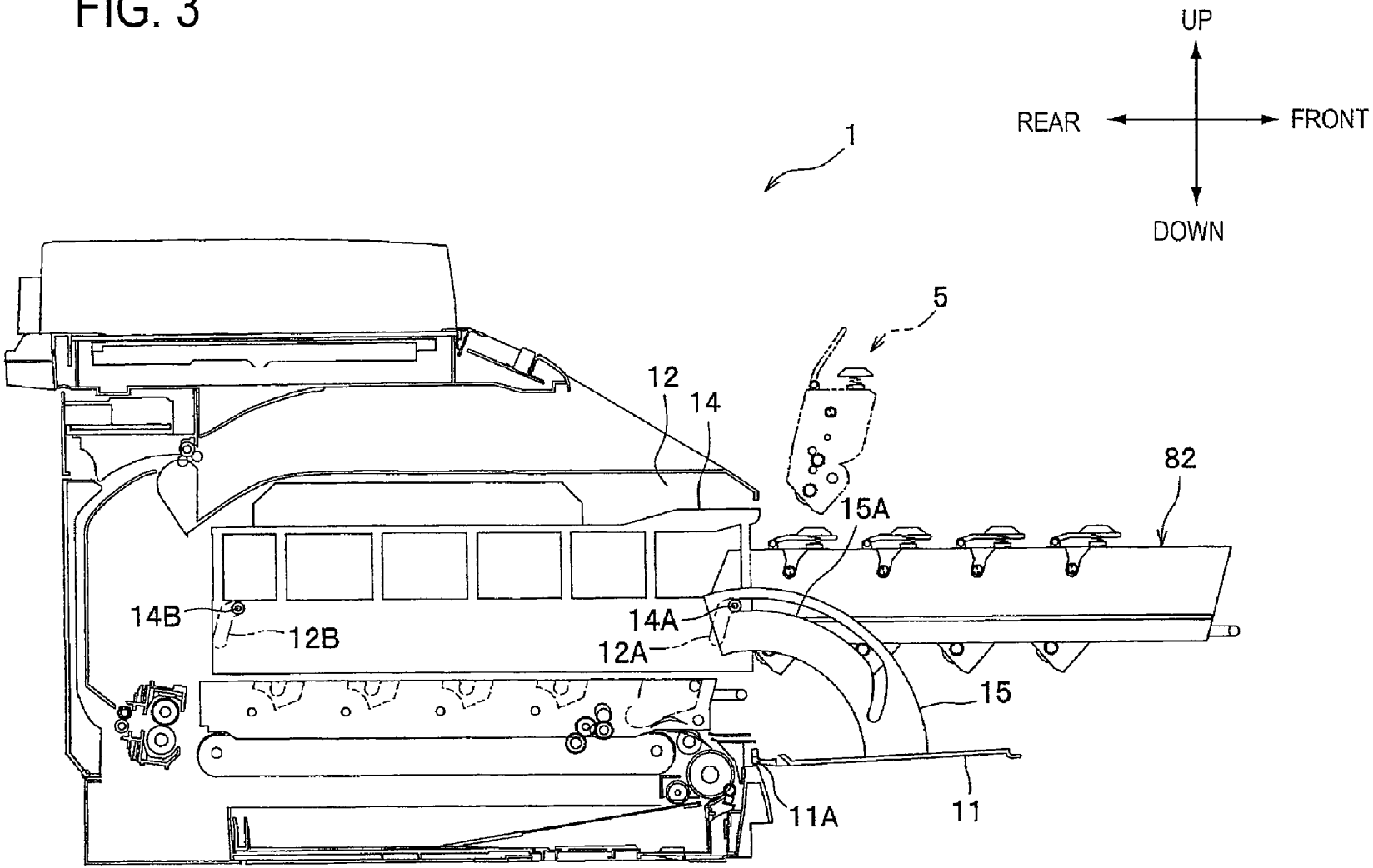
FIG. 3 is a cross-sectional view of the color printer according to the present invention when the developing device drawer is pulled out.

The supporting frames 14 support the second drawer 82 such that the second drawer 82 is movable with respect to the front-to-rear direction, as shown in FIG. 3. Each of the supporting frames 14 has a front protrusion 14A at a front end portion thereof and a rear protrusion 14B at a rear end portion thereof. The front protrusion 14A and the rear protrusion 14B are formed in a roller shape protruding outward in the left-to-right direction from each supporting frame 14. Each of the side frames 12 of the main body 10 is formed with a front groove 12A and a rear groove 12B. The front protrusion 14A and the rear protrusion 14B are supported to the front groove 12A and the rear groove 12B respectively such that the front protrusion 14A and the rear protrusion 14B can move within the corresponding front groove 12A and the rear groove 12B. The front groove 12A and the rear groove 12B are formed in a substantially L shape, each first extending diagonally upward front and then bending toward substantially forward.

Each lifter plate 15 is formed in a substantially arcuate shape, and is fixed to an inner surface of the front cover 11. Each lifter plate 15 is formed with a guide groove 15A for movably supporting the front protrusion 14A of each supporting frame 14 therewithin. The guide groove 15A is configured of an arc portion and a curvilinear portion. The arc portion extends along the lifter plate 15 so as to form an arc whose center of a radius of a curvature is coincident with the pivot shaft 11A. That is, the front protrusion 14A is movable relative to the corresponding side frame 12. The curvilinear portion extends from a front end of the arc portion toward the pivot shaft 11A.

A part of the guide groove 15A is always aligned with a part of the front groove 12A so that the front protrusion 14A extends through the guide groove 15A and the front groove 12A. When the front cover 11 is opened, the guide groove 15A urges the front protrusion 14A to move upward in conjunction with the movement of the front cover 11, thereby lifting the front side of the supporting frames 14 upward along the front groove 12A.

When the front protrusion 14A is pushed upward in conjunction with the movement of the front cover 11, the rear protrusion 14B is also urged to move upward along the rear groove 12B, thereby lifting the rear side of the supporting frames 14 upward.

Upon completion of opening the front cover 11, a rear end of the arc portion of the guide groove 15A pushes the front protrusion 14A forward, thereby moving the front protrusion 14A forward up to a front end of the front groove 12A, as shown in FIGS. 2 and 3. Simultaneously, the rear protrusion 14B is also pushed forward in conjunction with the movement of the front protrusion 14A, moving to a front end of the rear groove 12B.

Next a detailed configuration of the cleaning unit 9 will be described with reference to FIGS. 4A to 6B. As shown in FIG. 1, the cleaning unit 9 is disposed at a side the same as the process cartridges 5 with respect to the conveyor belt 61. As described earlier, since the cleaning unit 9 is fixed to the first drawer 81, the cleaning unit 9 can be pulled out from the main body 10 along with the first drawer 81.

The cleaning unit 9 includes a cleaning roller 91, a collection roller 92 and a waste toner box 93 (see FIG. 1). The cleaning roller 91 contacts the conveyor belt 61 and collects toner and paper dusts deposited on the conveyor belt 61. Specifically, a backup roller 94 is disposed within the loop of the conveyor belt 61, as shown in FIG. 1. The cleaning roller 91 cleans the conveyor belt 61 upon application of a prescribed bias between the backup roller 94 and the cleaning roller 91.

The collection roller 92 is disposed at a position diagonally upward and forward of the cleaning roller 91. The collection roller 92 is in sliding contact with the cleaning roller 91 so as to receive the toner and paper dusts collected by the cleaning roller 91.

The waste toner box 93 is a container for accommodating therein the toner and paper dusts scraped away from the collection roller 92. The waste toner box 93 has a bottom surface located diagonally downward and forward of the collection roller 92.

Figure 4A:
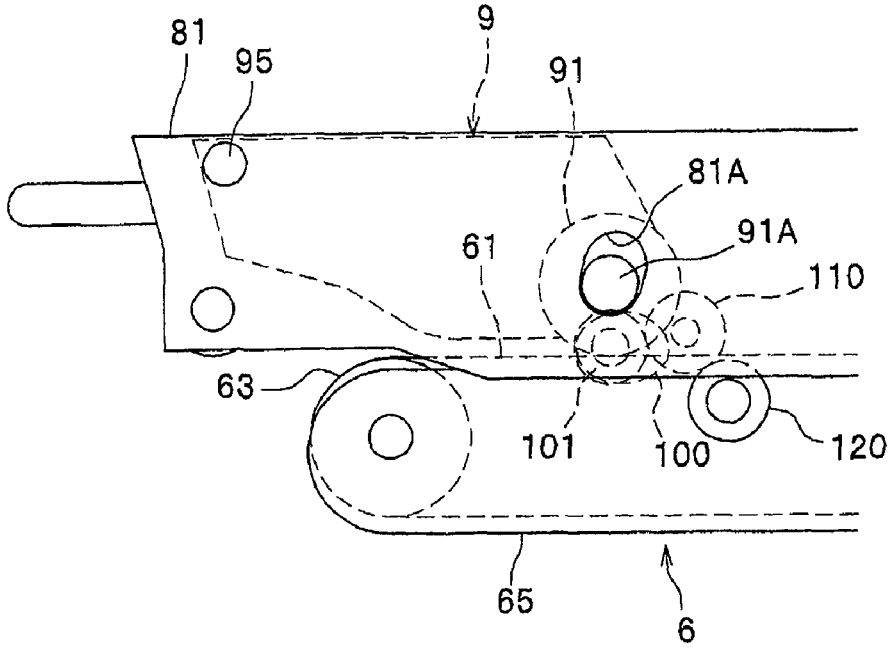
FIG. 4A is an explanatory view illustrating a relationship between the conveyor belt and the cleaning unit in which the conveyor belt and the cleaning unit is in contact with each other.
Figure 4B:
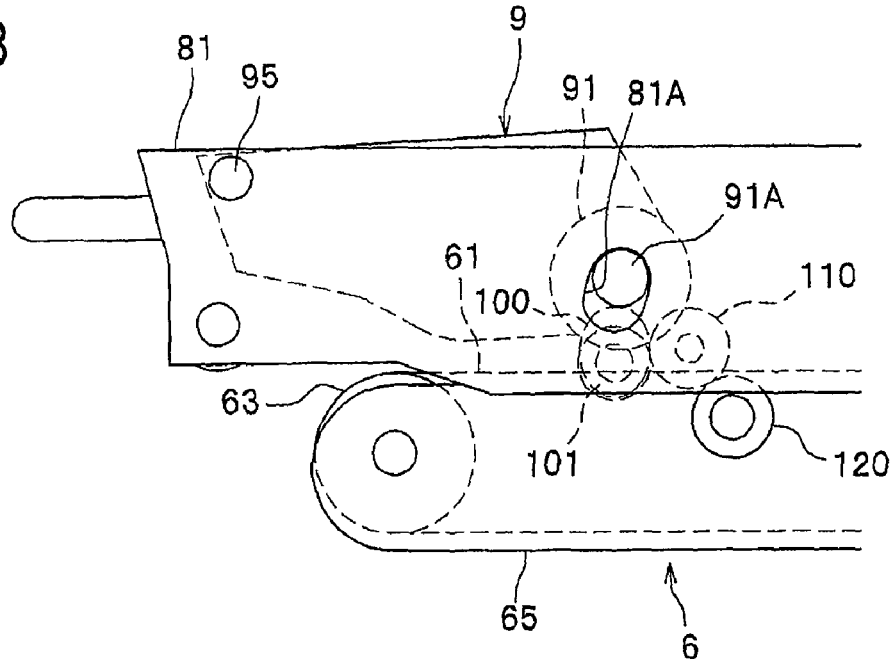
FIG. 4B is an explanatory view illustrating a relationship between the conveyor belt and the cleaning unit in which the cleaning unit is separated from the conveyor belt.

As shown in FIGS. 4A and 4B, in the cleaning unit 9, the cleaning roller 91 is pivotably movably supported to the first drawer 81 so that the cleaning roller 91 can move between a position in contact with the conveyor belt 61 and a position away from the conveyor belt 61. More specifically, the cleaning unit 9 has a pivot shaft 95 provided in the waste toner box 93 at a side opposite to the cleaning roller 91.

The cleaning roller 91 includes a rotational shaft 91A. The rotational shaft 91A extends outward from the outer surface of the first drawer 81 in the left-to-right direction, and is movably supported to guide grooves 81A formed on left and right side frames of the first drawer 81. The guide groove 81 A is formed in a substantially arc shape whose center of a radius of a curvature is coincident with an axis of the pivot shaft 95.

A pair of cams 100 is rotatably supported to the first drawer 81 at widthwise end portions thereof. Each cam 100 is controlled by a control unit (not shown) to lie down while printing is not performed, but to stand upright in case of printing. When the color printer 1 performs printing, the cams 100 urge both ends of the rotational shaft 91A of the cleaning roller 91 upward so that the cleaning roller 91 can separate from the conveyor belt 61.

Each cam 100 is integrally formed with a gear teeth section 101. Driving force is transmitted to each gear teeth section 101 via a first gear 110 and a second gear 120.

Each first gear 110 is rotatably supported to the first drawer 81 so as to meshingly engage corresponding gear teeth section 101 of the cam 100. Each second gear 120 is rotatably supported to the frame 65 of the belt unit 6. The second gears 120 are disposed such that the conveyor belt 61 is interposed therebetween in the left-to-right direction. Each second gear 120 meshingly engages respective first gear 110 for transmitting the driving force transmitted from a motor (not shown) provided in the main body 10.

Figure 5A:
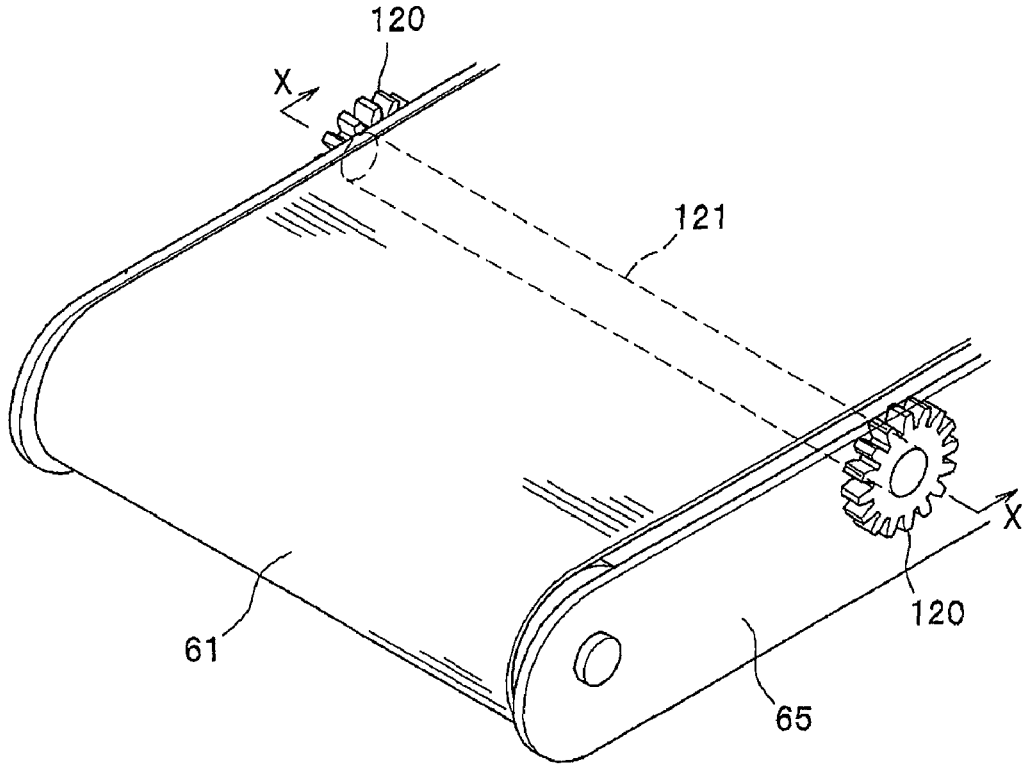
FIG. 5A is a perspective view showing the conveyor belt and a connection shaft disposed therewithin.
Figure 5B:
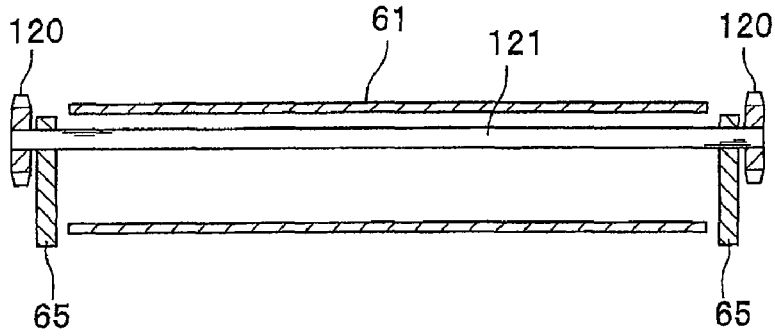
FIG. 5B is a cross-sectional view taken along a line X-X shown in FIG. 5A.

As shown in FIGS. 5A and 5B, a connection shaft 121 coaxially connects each second gear 120 so that the second gears 120 can move synchronously in conjunction with the rotation of the connection shaft 121. The connection shaft 121 is disposed within the loop of the conveyor belt 61. With this configuration, both of the cams 100 are allowed to rotate integrally and synchronously, thereby enabling the rotational shaft 91A of the cleaning roller 91 to be pushed upward in a balanced manner with respect to the left-to-right direction.

Figure 6A:
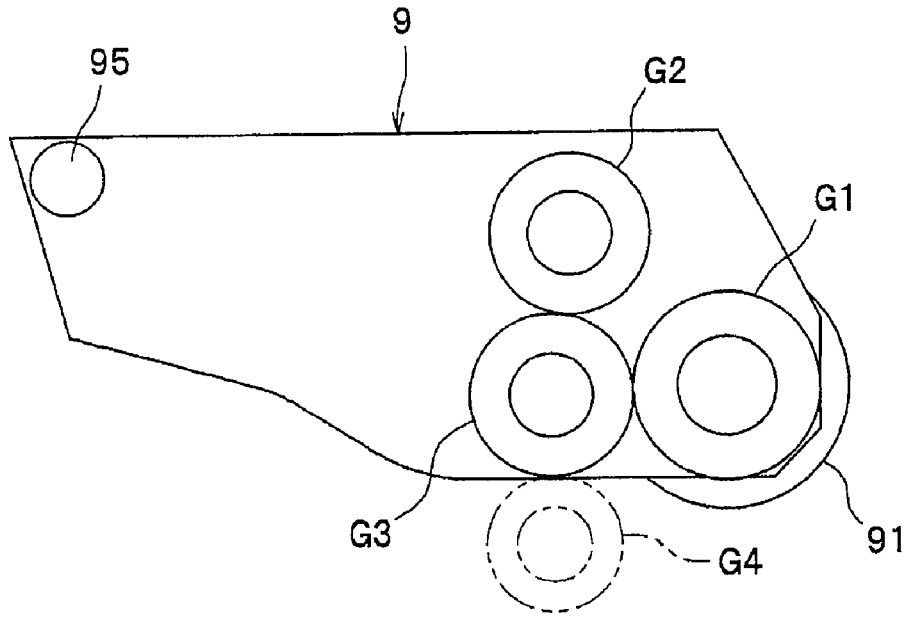
FIG. 6A is an explanatory view illustrating a relationship between the cleaning unit and a main body gear provided on a main body of the color printer, in which the cleaning unit and the main body gear meshingly engage with each other.
Figure 6B:
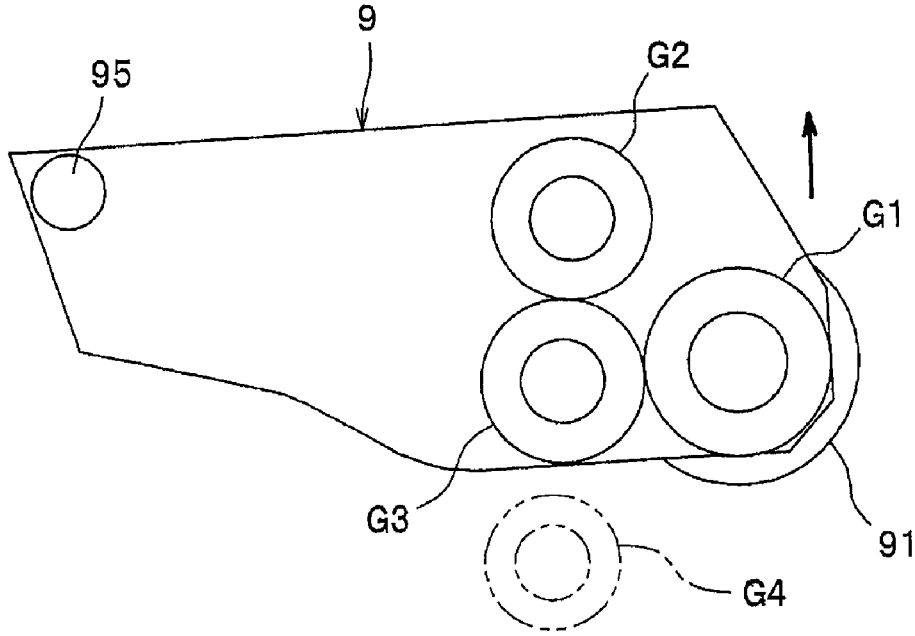
FIG. 6B is an explanatory view illustrating a relationship between the cleaning unit and the main body gear, in which the cleaning unit is disengaged from the main body gear.

As shown in FIGS. 6A and 6B, the cleaning unit 9 is further provided with a gear G1, a gear G2 and an input gear G3. The gear G1 enables the cleaning roller 91 to rotate in conjunction therewith, while the gear G2 enables the collection roller 92 to rotate in conjunction therewith. The input gear G3 transmits the driving force to the gears G1 and G2. A main body gear G4 is provided in the main body 10 for transmitting the driving force to the input gear G3. The input gear G3 is configured to engage with and disengage from the main body gear G4, in accordance with the pivotal movement of the cleaning unit 9 as shown in FIGS. 6A and 6B.

Next, a maintenance method of the cleaning unit 9 will be described with reference to FIG. 2. Due to long-term use of the color printer 1, when toner and paper dusts are fully accumulated within the cleaning unit 9 (the waste toner box 93) or when life of any photosensitive drum 51 is over, maintenance to the cleaning unit 9 is required.

For this maintenance purpose, a worker (a user or a repair man) first opens the front cover 11 as shown in FIG. 2. At this time, the separation mechanism 13 separates the second drawer 82 away from the first drawer 81. Hence, the first drawer 81 alone can be pulled out from the main body 10. Thus, the cleaning unit 9 can be cleaned up and the outlived photosensitive drum 51 can be replaced with a new one.

With the above-described configuration, since the cleaning unit 9 is disposed a side the same as the process cartridges 5 with respect to the conveyor belt 61, maintenance can be performed on the cleaning unit 9, without removing the conveyor belt 61 from the main body 10, just as easily as each process cartridge 5 is taken out of the main body 10. Further, the cleaning unit 9 can be removed from the main body 10 integrally with each drum unit 52. Hence, one simple action of pulling the first drawer 81 from the main body 10 enables the worker to perform maintenance on the cleaning unit 9 and the drum units 52.

Further, the above-described configuration of the present embodiment can downsize the color printer 1 compared to a configuration in which the cleaning unit 9 and the process cartridges 5 are disposed at a side different from each other with respect to the conveyor belt 61.

Further, the cleaning unit 9 is fixed to the first drawer 81 in the present embodiment. Suppose that the cleaning unit 9 is allowed to be detachably mounted in the first drawer 81. In this case, when each drum unit 52 is replaced with new one after the first drawer 81 is removed from the main body 10, a new drum unit 52 may possibly be installed at a place where the cleaning unit 9 should be mounted. The present embodiment can prevent such a wrong installation of the drum unit 52.

Further, the cleaning unit 9 is pivotably movably supported to the first drawer 81 so that the cleaning roller 91 can be in separation from and in contact with the conveyor belt 61. Hence, the cleaning roller 91 is allowed to separate from the conveyor belt 61 at the time of printing, thereby preventing the cleaning roller 91 from obstructing the conveyance of the sheet P on the conveyor belt 61.

Further, the photosensitive drums 51 (the drum units 52) and the cleaning unit 9 are all disposed on the first drawer 81 in the present embodiment. Hence, when there are no more service lives left for the photosensitive drums 51 (the drum units 52) and the cleaning unit 9, simply replacing the first drawer 81 as a whole enables the photosensitive drums 51 and the cleaning unit 9 to be replaced at a time. In order for the service lives of the photosensitive drums 51 and the cleaning unit 9 to be ended at the same time, the capacity of the waste toner box 93 may be set such that the service life of the photosensitive drum 51 and a period of time required for the waste toner box 93 to become full with the collected toner and paper dusts can be substantially coincident with each other.

Further, the separation mechanism 13 is provided for separating the second drawer 82 from the first drawer 81 in accordance with the front cover 11 being opened. With this construction, the first drawer 81 can be pulled out easily from the main body 10 without causing interference with the second drawer 82.

Further, the pivot shaft 95 of the cleaning unit 9 is provided in the waste toner box 93 at the side opposite to the cleaning roller 91 in the present embodiment. Therefore, the conveyor belt 61 can be reliably separated from the cleaning roller 91 only by moving (tilting) the cleaning unit 9 slightly upward.

Further, the pair of second gears 120 is coaxially connected via the connection shaft 121, thereby enabling the cams 100 (disposed in the left-to-rear direction) to rotate synchronously. This synchronous rotation of the cams 100 allows the rotational shaft 91A of the cleaning roller 91 to be pushed upward in a balanced manner, thereby reliably separating the cleaning roller 91 from the conveyor belt 61.

Further, the connection shaft 121 is disposed within the conveyor belt 61 (inside the loop of the conveyor belt 61). Hence, in comparison to a configuration in which the connection shaft 121 is disposed outside of the conveyor belt 61, the color printer 1 of present embodiment can be made compact.

While the invention has been described in detail with reference to the specific embodiment thereof, it would be apparent to those skilled in the art that various changes and modifications may be made therein without departing from the spirit of the invention.

For example, the drawer 8 is configured of two drawers (the first drawer 81 and the second drawer 82) in the present embodiment. However, the drawer 8 may be configured as a single drawer. In this case, the cleaning unit 9 and the drum units 52 are fixed to the single drawer, while the developing devices 54 are configured to be detachably mountable therein. When the cleaning unit 9 and the drum units 52 need to be replaced, the user may remove each developing device 54 from the drawer 8 and then replace the drawer 8 as a while with a new drawer. In this way, the cleaning unit 9 and the drum units 52 can be replaced all at once.

Further, instead of the conveyor belt 61, an intermediate transfer belt may be employed for sequentially transferring the toner images carried on each photosensitive drum 51 thereonto.

Not only to the color printer 1 as in the present embodiment, the present invention may also be applicable to other types of image forming apparatuses, such as a multifunctional device and a copier.

Although the sheet P is used in the present embodiment as an example of recoding mediums (the sheet P including a post card, a cardboard and a thin paper), the present invention is not so limited but may be applied to a transparent sheet, for example, OHP sheet.

Further, the cleaning roller 91 of the present embodiment has a roller shape. However, a cleaning member having a shape other than the roller shape may also be employed.

As an alternative to the separation mechanism 13 that is mechanically-connected to the front cover 11, there may be employed a mechanism for detecting movement (opening/closing) of the front cover 11. In this case, signals indicative of the movement of the front cover 11 are outputted, and the second drawer 82 is separated from the first drawer 81 in accordance with the signals, using a cylinder or the like.

What is claimed is:

1. An image forming apparatus comprising:

a main body;

a drawer movably supported by the main body and configured to be pulled out from an interior of the main body, the drawer including a first drawer and a second drawer;

an image forming unit supported on the drawer and having a plurality of photosensitive drums arrayed in line in a direction for forming an image on a recording medium, wherein the image forming unit further comprises:

a plurality of drum units each accommodating a respective one of the plurality of photosensitive drums, the first drawer supporting the plurality of drum units; and a plurality of developing devices each being detachably mountable in each of the plurality of drum units, each developing device having a developing roller that supplies toner to each one of the plurality of photosensitive drums, the second drawer that supports the plurality of developing devices;

a belt unit disposed in opposition to each of the plurality of photosensitive drums and extending in the direction for forming an image on a recording medium, the belt unit including an endless belt; and a cleaning unit fixed to the first drawer and including a cleaning member disposed to be in contact with the endless belt for collecting toner deposited thereon, wherein the first and second drawers are configured to be pulled out from the main body independently of the belt unit and the cleaning unit is configured to be pulled out integrally with the plurality of drum units from the main body.

2. The image forming apparatus as claimed in claim 1, further comprising a front cover pivotally movably connected to the main body and movable between an open position and a closed position, the first drawer and the second drawer configured to be pulled out from the main body when the front cover is at the open position.

3. The image forming apparatus as claimed in claim 2, further comprising a separation mechanism that moves the second drawer away from the first drawer in conjunction with the pivotal movement of the front cover toward the open position.

4. The image forming apparatus as claimed in claim 3, wherein the main body is formed with a first guide groove; and wherein the separation mechanism comprises:

a support frame movably supported by the main body and supporting the second drawer;

a protrusion protruding from the support frame and slidingly engaged with the first guide groove; and a lifter plate movable in interlocking relation to the pivotal movement of the front cover, the lifter plate being formed with a second guide groove with which the protrusion is slidingly engaged, the second guide groove being configured to change a vertical position of the protrusion along the first guide groove in accordance with the movement of the lifter plate.

5. The image forming apparatus as claimed in claim 1, wherein the belt unit is configured to convey the recording medium in direct confrontation with the plurality of photosensitive drums; and wherein the cleaning unit further comprises a container configured to accommodate the toner collected by the cleaning member, the cleaning unit being pivotally movable to permit the cleaning member to move toward and away from the belt unit.

6. The image forming apparatus as claimed in claim 5, further comprising a pivot shaft supported by the drawer, wherein the container is pivotally movable about the pivot shaft, and the pivot shaft is positioned at a side opposite to the cleaning member with respect to the container.

7. The image forming apparatus as claimed in claim 6, further comprising a mechanism for pivotally moving the cleaning unit, the mechanism comprises a cam unit rotatably supported to the drawer and in contact with the cleaning unit, the cam unit configured to be rotated at a first angular rotation to move the cleaning unit to a first position where the cleaning member is in contact with the belt unit during a period other than an image forming operation, and configured to be rotated at a second angular rotation to move the cleaning unit to a second position where the cleaning member is away from the belt unit during the image forming operation.

8. The image forming apparatus as claimed in claim 7, wherein the belt unit further comprises a pair of support frames, a drive roller rotatably supported by the pair of support frames for driving the endless belt, and a driven roller rotatably supported by the pair of support frames; and wherein the cam unit includes a first cam positioned at one side of the cleaning unit in a widthwise direction of the endless belt, and a second cam positioned at another side of the cleaning unit in the widthwise direction; and wherein the mechanism for pivotally moving the cleaning unit further comprises a plurality of power transmission gears for driving the first cam and the second cam, the plurality of power transmission gears including a pair of gears each positioned outward of the endless belt in the widthwise direction, and a connection shaft extending through an internal loop space of the endless belt to coaxially mount the pair of gears.

* * * * *